US007335844B2

(12) United States Patent
Lee et al.

(10) Patent No.: US 7,335,844 B2
(45) Date of Patent: Feb. 26, 2008

(54) KEYPAD ASSEMBLY FOR ELECTRONIC DEVICE

(75) Inventors: Joo-Hoon Lee, Yongin-si (KR); Byung-Duck Cho, Seoul (KR); Dong-Hoon Jang, Suwon-si (KR); Sun-Tae Jung, Anyang-si (KR)

(73) Assignee: Samsung Electronics Co., Ltd., Suwon-Si, Gyeonggi-Do (KR)

( * ) Notice: Subject to any disclaimer, the term of this patent is extended or adjusted under 35 U.S.C. 154(b) by 0 days.

(21) Appl. No.: 11/670,476

(22) Filed: Feb. 2, 2007

(65) Prior Publication Data

US 2007/0205088 A1 Sep. 6, 2007

(30) Foreign Application Priority Data

Mar. 3, 2006 (KR) ..... 10-2006-0020658

(51) Int. Cl.
*H01H 9/18* (2006.01)

(52) U.S. Cl. ..... 200/310; 200/311; 200/314

(58) Field of Classification Search ..... 200/308, 200/310–314; 341/20, 22, 23; 345/168–170; 379/368, 433.07, 433.01; 455/90.3, 566, 455/575.1, 575.3, 575.4, 575.9
See application file for complete search history.

(56) References Cited

U.S. PATENT DOCUMENTS

| | | | | |
|---|---|---|---|---|
| 5,040,479 | A * | 8/1991 | Thrash | 116/279 |
| 5,408,060 | A * | 4/1995 | Muurinen | 200/314 |
| 5,950,809 | A * | 9/1999 | Andre | 200/314 |
| 6,608,271 | B2 * | 8/2003 | Duarte | 200/311 |
| 6,868,259 | B1 * | 3/2005 | Kitamura et al. | 455/90.3 |
| 6,987,466 | B1 * | 1/2006 | Welch et al. | 341/22 |
| 7,005,595 | B1 * | 2/2006 | Tang | 200/310 |
| 7,091,434 | B2 * | 8/2006 | Suzuki | 200/316 |
| 7,187,306 | B2 * | 3/2007 | Makino et al. | 341/21 |
| 7,244,899 | B2 * | 7/2007 | Jung et al. | 200/314 |

* cited by examiner

*Primary Examiner*—Michael A Friedhofer
(74) *Attorney, Agent, or Firm*—Cha & Reiter, LLC

(57) ABSTRACT

A keypad assembly for an electronic device is disclosed. The keypad assembly includes a light guide plate through which a light moves, a plurality of first key buttons on the top surface of the light guide plate, a plurality of reflecting patterns on the bottom surface of the light guide plate for reflecting the light moving through the light guide plate toward the first key buttons, protrusions under the reflecting patterns, a plurality of light emitting devices for supplying the light to the light guide plate, and a switch board including a plurality of dome switches and at least one first optical filtering layer whose color is changed into various colors by reacting or not reacting to the wavelengths of lights generated from the light emitting devices is included under each of the first key buttons.

21 Claims, 9 Drawing Sheets

KEYPAD ASSEMBLY FOR ELECTRONIC DEVICE

CLAIM OF PRIORITY

This application claims the benefit of the earlier filing date, pursuant to 35 U.S.C. § 119, to that patent application entitled "Keypad Assembly for Electronic Device," filed in the Korean Intellectual Property Office on Mar. 3, 2006 and assigned Serial No. 2006-20658, the contents of which are incorporated herein by reference.

BACKGROUND OF THE INVENTION

1. Field of the Invention

The present invention generally relates to a keypad assembly for an electronic device, and in particular, to a keypad assembly in which key buttons of the electronic device each include at least one optical filtering layer that changes the color of an input light wavelength by reacting or not reacting to the light wavelengths generated from at least two light emitting devices.

2. Description of the Related Art

Generally, a "portable communication apparatus" refers to an electronic apparatus which provides electrical communication between users and service providers. As examples of the portable communication apparatus, there are HHPs (hand held phones), CT-2 cellular phones, digital phones, PCS (personal communication service) phones, and PDAs (personal digital assistants). Conventional portable communication apparatuses may be classified in various types according to their appearance. For example, wireless terminals are classified into bar-type wireless terminals, flip-type wireless terminals, and folder-type wireless terminals according to their appearance. The conventional portable terminals are equipped with antenna devices, data input/output devices, and data transmission/reception devices. As the data input/output devices, keypads allowing data input through a finger press task are generally used.

A keypad used for data input includes a plate-shaped elastic pad, a plurality of key buttons on the top surface of the elastic pad, having characters printed thereon, and a plurality of protrusions on the bottom surface of the elastic pad. The portable terminals generally include a plurality of (typically 15-20) light emitting devices for backlighting the key pad.

FIG. 1 is a cross-sectional view of a conventional keypad assembly 1. The keypad assembly 1 includes a keypad 2, a switch board 3, and a plurality of Light Emitting Diodes (LEDs) 4.

The keypad 2 includes an elastic pad 2*a* that is made of a flexible material (e.g., rubber) and is plate-shaped, a plurality of key buttons 2*b* that are formed on the top surface of the elastic pad 2*a* and has numbers and characters printed thereon, and a plurality of protrusions that are formed on the bottom surface of the elastic pad 2*a*.

Each of the protrusions 2*c* is arranged at the center of each of the key buttons 2*b* and a plurality of grooves 5 may be formed in the bottom face of the elastic pad 2*a*. The grooves 5 are arranged around the protrusions 2*c* in such a way to avoid interference caused by the LEDs 4 and the protrusions 2*c*.

The switch board 3 includes a plate-shaped Printed Circuit Board (PCB) and a plurality of dome switches 3*a* formed on the top surface of the PCB facing the keypad 2.

The LEDs 4 are amounted on the top surface of the PCB and are positioned to be covered by the grooves 5 of the elastic pad 2*a*.

If a user presses one of the key buttons 2*b*, a portion of the keypad 2 under the pressed key button 2*b* is transformed towards the switch board 3 and thus the protrusion 2*c* included in the transformed portion presses the dome switch 3*a*. A contact member 6 included in the dome switch 3*a* electrically contacts the protrusion 2*c*.

For operations of the dome switches 3*a*, the LEDs 4 cannot be positioned under the key buttons 2*b*. Since a light A1 output from each of the LEDs 4 passes through the elastic pad 2*a* and illuminates each of the key buttons 2*b* in the form of a square, the illumination of the key button 2*b* is non-uniform and dark.

If a large number of LEDs 4 are installed to uniformly and brightly illuminate the key buttons 2*b*, power consumption increases. Moreover, due to a large number of parts, the time required for the assembly of a terminal and manufacturing cost of the terminal increase.

To address the problems, a keypad assembly including a light guide plate and reflecting patterns has been developed as shown in FIG. 2.

FIG. 2 is a cross-sectional view showing a light guide plate 20 and a plurality of reflecting patterns 40 in a conventional keypad assembly 10. Referring to FIG. 2, the keypad assembly 10 includes the light guide plate 20 through which a light moves, a plurality of key buttons 30 that are formed on the top surface of the light guide plate 20 and have numbers and characters printed thereon, the reflecting patterns 40 that are formed on the bottom surface of the light guide plate 20 and reflect the light A1 moving through the light guide plate 20 towards the key buttons 30, protrusions 50 under the reflecting patterns 40, a plurality of light emitting devices 70 that provide the light A1 to the light guide plate 20, and a switch board 60 including dome switches 80.

The single light guide plate 20 is provided for the illumination of the entire key buttons 30.

As such, the entire key buttons 30 can be illuminated using the light guide plate 20, but the numbers and characters printed on the key buttons 3 cannot be separately illuminated. As a result, the utility of the numbers and characters of the key buttons 30 may be degraded in some modes of the terminal.

SUMMARY OF THE INVENTION

The present invention provides a keypad assembly for an electronic device, in which key buttons of the electronic device each include at least one optical filtering layer which changes the color of an input light wavelength by reacting or not reacting to the light wavelengths generated from at least two light emitting devices, thereby allowing numbers and characters printed on the key buttons to express different colors.

It is one aspect of the present invention to provide a keypad assembly for an electronic device, in which numbers and characters printed on key buttons of the electronic device are separately illuminated with different colors, thereby improving the utility of the key buttons.

It is another aspect of the present invention to provide a keypad assembly for an electronic device, in which special character faces on key buttons of the electronic device each include at least one optical filtering layer that changes the color of an input light wavelength by reacting to light wavelengths generated from at least two light emitting devices, thereby allowing the special characters to express different colors.

According to yet another aspect of the present invention, there is provided a keypad assembly for an electronic device. The keypad assembly includes a light guide plate through which a light moves, a plurality of first key buttons on the top surface of the light guide plate, a plurality of reflecting patterns on the bottom surface of the light guide plate for reflecting the light moving through the light guide plate toward the first key buttons, protrusions under the reflecting patterns, a plurality of light emitting devices for supplying the light to the light guide plate, and a switch board including a plurality of dome switches And at least one first optical filtering layer whose color is changed into other colors by reacting or not reacting to the wavelengths of lights generated from the light emitting devices is included under each of the first key buttons.

According to another aspect of the present invention, there is provided a keypad assembly for an electronic device. The keypad assembly includes a light guide plate through which a light moves, a plurality of key buttons on the top surface of the light guide plate, a plurality of reflecting patterns on the bottom surface of the light guide plate for reflecting the light moving through the light guide plate toward the key buttons, protrusions under the reflecting patterns, a plurality of light emitting devices for supplying the light to the light guide plate, and a switch board including a plurality of dome switches and at least one first and second optical filtering layers whose colors are changed into other colors by reacting or not reacting to the wavelengths of lights generated from the light emitting devices are included under a number face and a character face of each of the key buttons, respectively.

BRIEF DESCRIPTION OF THE DRAWINGS

The above features and advantages of the present invention will become more apparent from the following detailed description when taken in conjunction with the accompanying drawings in which.

DETAILED DESCRIPTION OF THE INVENTION

Figure 1:
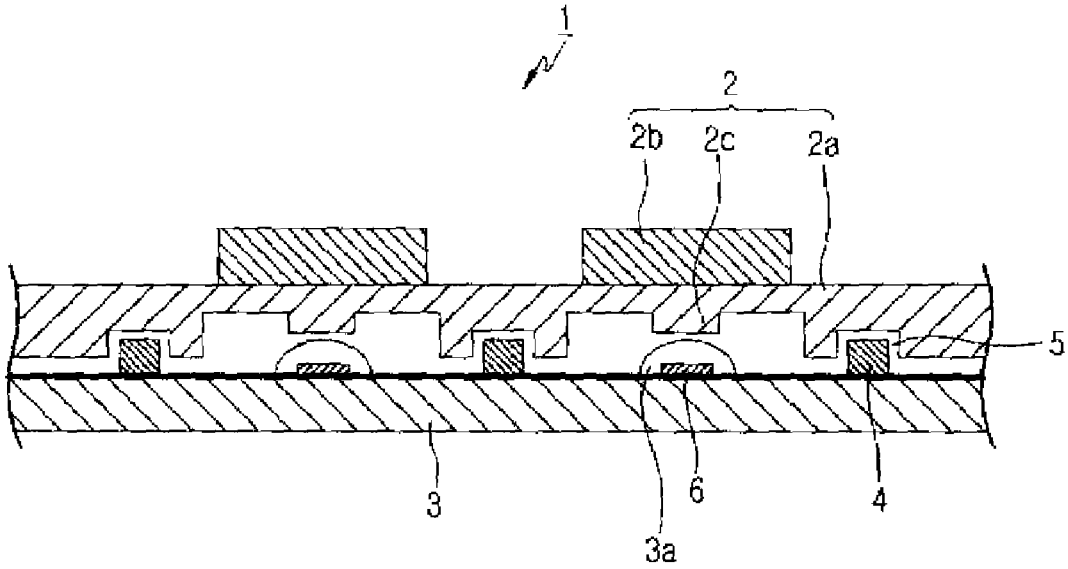
FIG.1 (PRIOR ART)
FIG. 1 is a cross-sectional view of a conventional keypad assembly.

Now, embodiments of the present invention will now be described in detail with reference to the annexed drawings. In the following description, elements having the identical functions with conventional functions will be designated by the same reference numerals.

Figure 3:
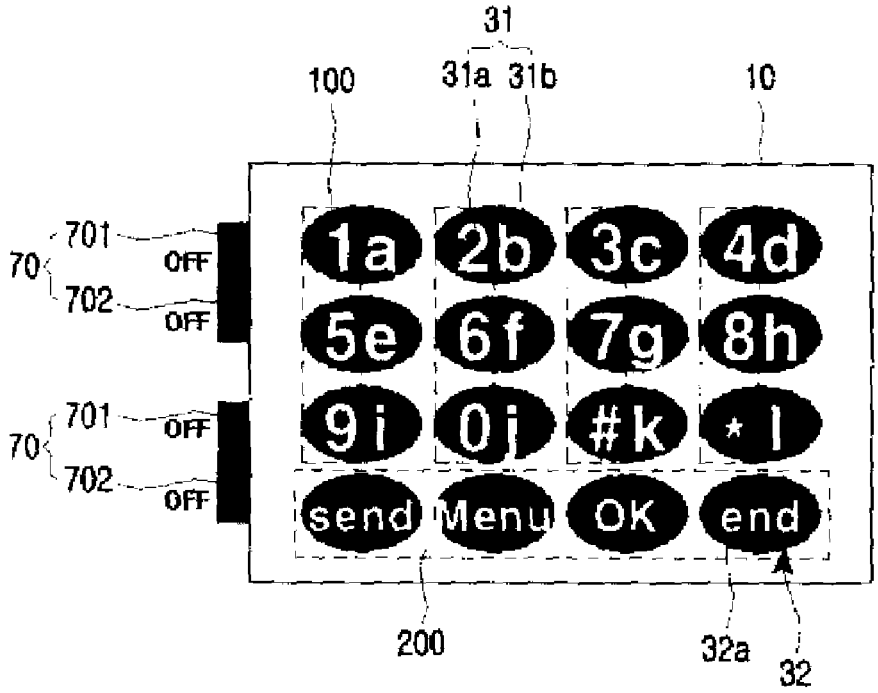
FIG. 3 is a front view of a keypad assembly for an electronic device according to a first embodiment of the present invention.

FIG. 3 is a front view of a keypad assembly 10 for an electronic device according to a first embodiment of the present invention.

Figure 2:
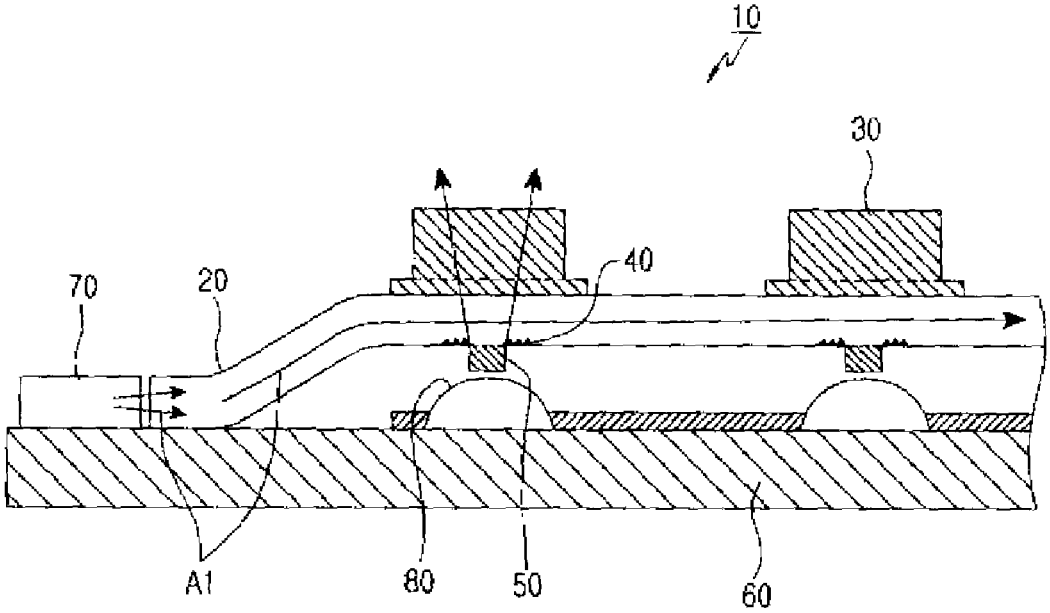
FIG.2 (PRIOR ART)
FIG. 2 is a cross-sectional view of a light guide plate and reflecting patterns in a conventional keypad assembly.

Similar to the conventional keypad assembly 10 shown in FIG. 2, the keypad assembly 10 includes a light guide plate 20 (not shown) through which light travels, a plurality of key buttons 30 (not shown) on the top surface of the light guide plate 20 (not shown), a plurality of reflecting patterns 40 (not shown) on the bottom surface of the light guide plate 20 (not shown) for reflecting a light traveling through the light guide plate 20 (not shown) toward the key buttons 30 (not shown), protrusions 50 (not shown) under the reflecting patterns 40 (not shown), a plurality of light emitting devices, each including a first light emitting device 701 and a second light emitting device 702, for supplying a light to the light guide plate, and a switch board 60 (not shown) including a plurality of dome switches 80 (not shown).

As shown in FIG. 3, at least one optical filtering layer 100 whose light output color is changed into other colors by reacting or not reacting to the wavelengths of lights generated from the first light emitting device 701 and the second light emitting device 702 is formed under the selected groups of key buttons 30. The optical filtering layers 100 are made, preferably, of phosphor.

The optical filtering layers 100 emit red, green, blue, and combinations thereof (e.g., purple or violet). In one aspect of the invention, the wavelength of a light generated from the first light emitting device 701 is 400 nm such that the optical filtering layers 100 react to produce an light output of another color and the wavelength of a light generated from the second light emitting device 702 is 470 nm such that the optical filtering layers 100 do not react and the light color produced is the same as the input light wavelength color.

Figure 4:
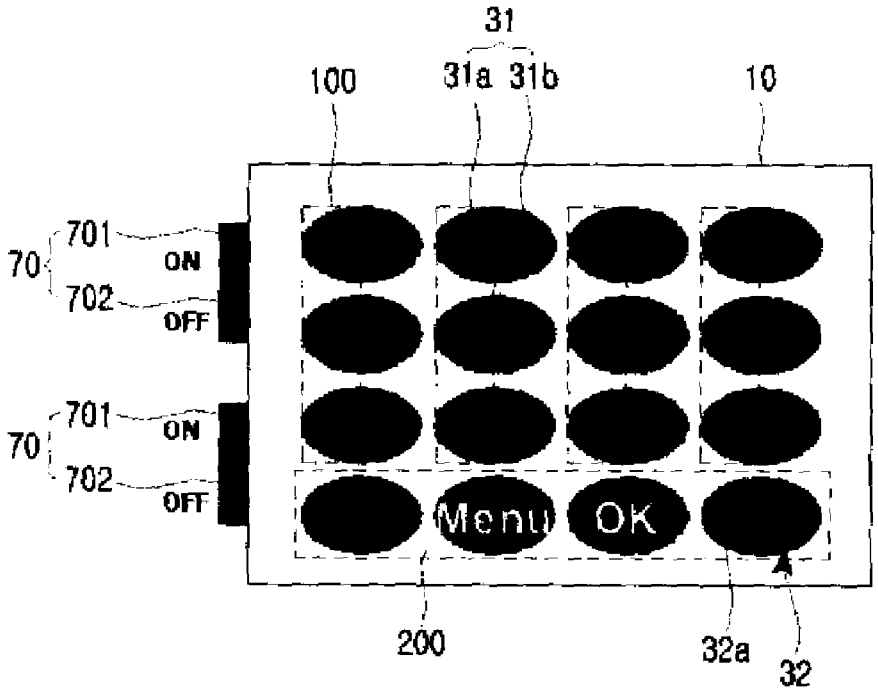
FIG. 4 is a front view of a keypad assembly for an electronic device according to a first embodiment of the present invention, in which a first light emitting device emits a light.
Figure 5:
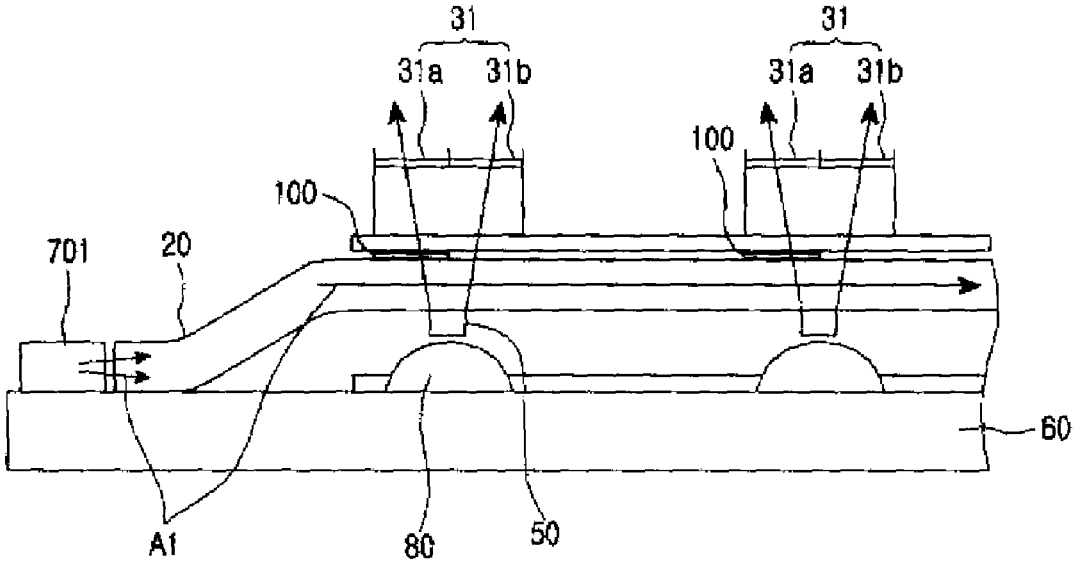
FIG. 5 is a cross-sectional view of a keypad assembly for an electronic device according to a first embodiment of the present invention, in which the first light emitting device emits a light.

Referring to FIGS. 4 and 5, when the first light emitting device 701 emits a light of 400 nm, the optical filtering layers 100 react and illuminate the key buttons 30 with various colors. For example, in one aspect of the invention, the number character of the keys 30 may be displayed in a red or pink color, while the letter character of the keys 30 may be displayed in a purple or violet color. In addition, the terms "send," "menu," "OK" and "end," may be grouped together and displayed in a totally different color, e.g., green.

Figure 7:
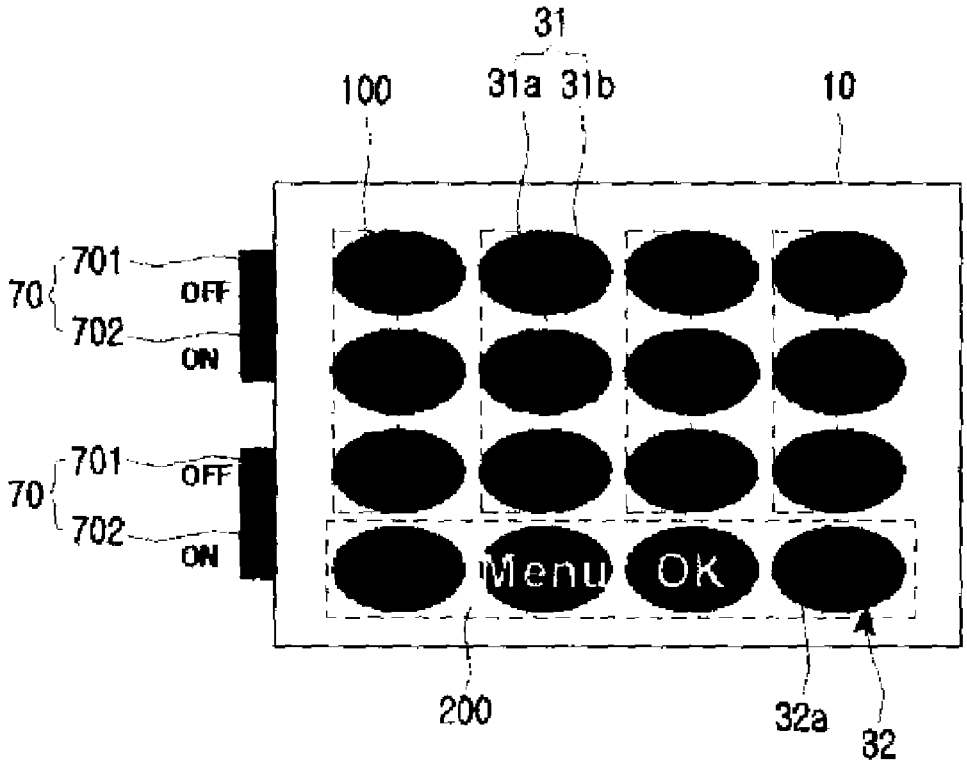
FIG. 7 is a front view of a keypad assembly for an electronic device according to a first embodiment of the present invention, in which a second light emitting device emits a light.
Figure 8:
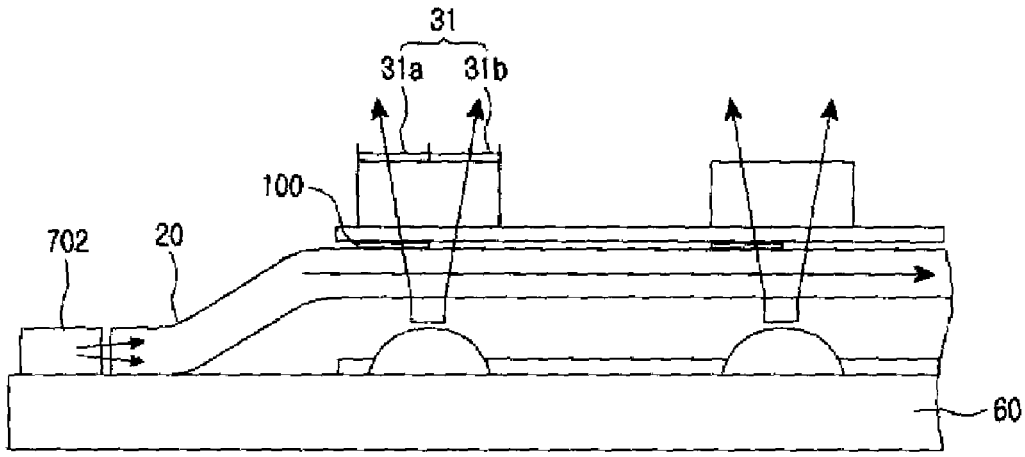
FIG. 8 is a cross-sectional view of a keypad assembly for an electronic device according to a first embodiment of the present invention, in which the second light emitting device emits a light.

Referring to FIGS. 7 and 8, when the second light emitting device 702 emits a light of 470 nm, the optical filtering layers 100 do not react and illuminate the key buttons 30 with a single color. For example, the number and letter characters on the keys 30 may be displayed in a blue color, i.e., 470 nm.

Printing faces 31 on which numbers and characters are printed are formed on the key buttons 30 and each of the printing faces 31 includes a number face 31*a* and a character face 31*b* (FIG. 3). The optical filtering layer 100 is selectively included under the number face 31*a* or the character face 31*b*.

As shown in FIGS. 4 and 7, key buttons 32 including special character faces 32*a* are included adjacent to the number faces 31*a* and the character faces 31*b* of the key buttons 30 and optical filtering layers 200 for illuminating the special character faces 31*b* with other colors by reacting to both 400 nm and 470 nm lights generated from the first light emitting device 701 and the second light emitting device 702 are included under the special character faces 32*a*.

According to another embodiment of the present invention, the light emitting devices 70 are included adjacent to the dome switches 80 of the switch board 60.

The optical filtering layer 100 can be selectively installed on or under the key buttons 30 or in positions according to the moving path of the light emitted from the light emitting devices 70.

Hereinafter, the operation of the keypad assembly 10 according to the first embodiment of the present invention will be described with reference to FIGS. 3 through 9 in more detail.

As shown in FIG. 3, the keypad assembly 10 includes the key buttons 30 having the number faces 31*a* and the character faces 31*b* on which numbers and characters are printed and the optical filtering layers 100 under the key buttons 30. The optical filtering layers 100 are made of phosphor. The optical filtering layer 100 is included under the number face 31*a* of the key button 30 and the first light emitting device 701 and the second light emitting device 702 for supplying a light A1 to the light guide plate 20 are included at a side of the key button 30.

Figure 6:
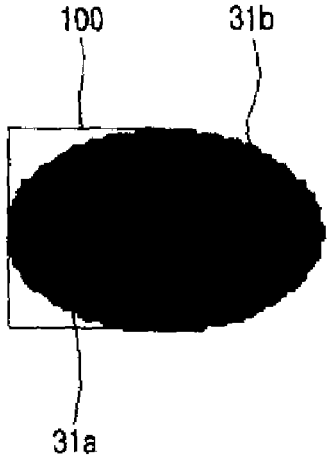
FIG. 6 is a front view of a keypad assembly for an electronic device according to a first embodiment of the present invention, in which key buttons are used when the first light emitting device emits a light.

In this state, as shown in FIGS. 4 through 6, when a keypad mode of a terminal is used for the input of characters, once the first light emitting device 701 is turned on, the first light emitting device 701 emits a violet (purple) light of 400 nm. At this time, the optical filtering layer 100 under the number face 31*a* reacts and illuminates the number face 31*a* with another color by emitting a light of another color (e.g., pink), and illuminates the character face 31*b* with violet.

As shown in FIG. 4, the number face 31*a* and the character face 31*b* of the key button 30 are illuminated with different colors. At this time, the second light emitting device 702 is in an OFF state.

Figure 9:
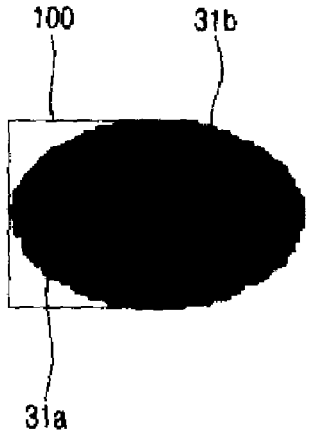
FIG. 9 is a front view of a keypad assembly for an electronic device according to a first embodiment of the present invention, in which key buttons are used when the second light emitting device emits a light.

As shown in FIGS. 7 through 9, when the keypad mode is used for other functions (games and moving picture watching), the first light emitting device 701 is turned off and the second light emitting device 702 is turned on. At this time, the second light emitting device 702 emits a blue light of 470 nm and the optical filtering layer 100 does not react and both the number face 31*a* and the character face 31*b* of the key button 30 are illuminated with a blue color.

As show in FIGS. 4 and 7, the key buttons 32 including the special character faces 32*b* are included adjacent to the number faces 31*a* and the character faces 31*b* of the key buttons 30 and the optical filtering layer optical filtering layers 200 for illuminating the special character faces 31*b* with various colors by reacting to both 400 nm and 470 nm of the lights generated from the first light emitting device 701 and the second light emitting device 702 are included under the special character faces 32*a*. Thus, when the first light emitting device 701 emits a light of 400 nm, the optical filtering layer 100 under the number face 31*a* of the key button 30 reacts and emits red or green lights and the optical filtering layer 200 under the special character face 32*a* of the key button 32 reacts and emits a light of another color (not red or green).

When the first light emitting device 702 emits a light of 470 nm, the optical filtering layer 100 under the number face 31*a* of the key button 30 does not react and the optical filtering layer 200 under the special character face 32*a* of the key button 32 reacts and emits light of various colors.

Here, the electronic device generally refers to a portable communication apparatus.

Hereinafter, the operation of the keypad assembly 10 according to a second embodiment of the present invention will be described with reference to FIGS. 10 through 14 in more detail.

Figure 10:
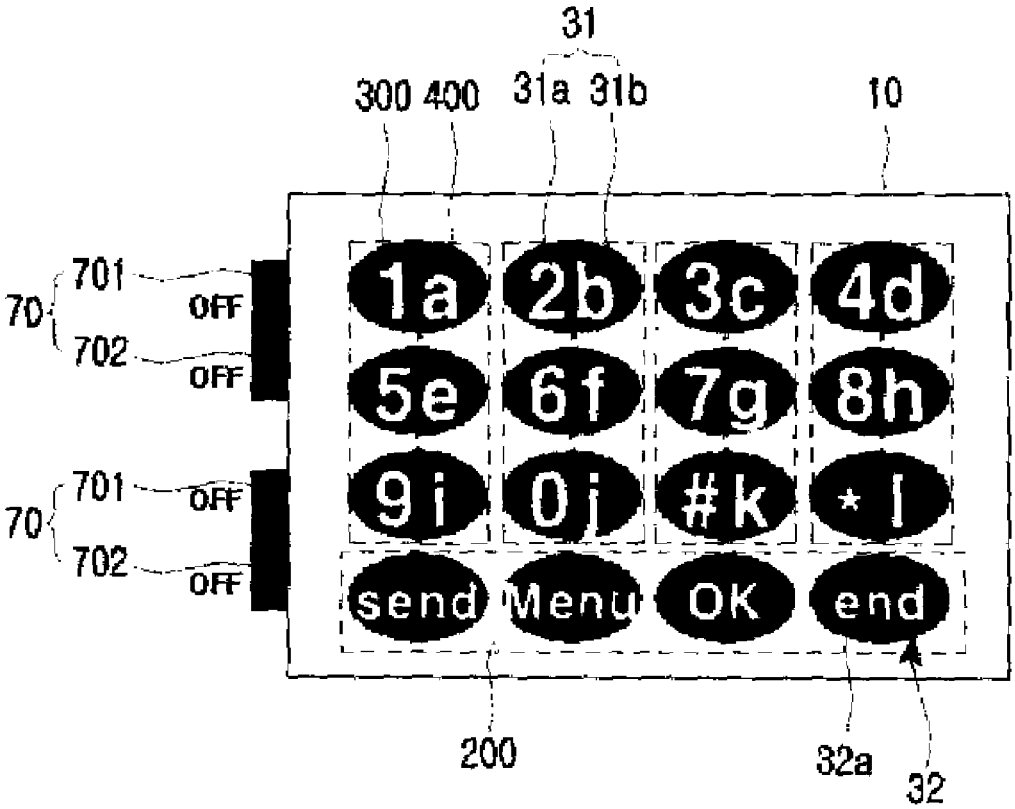
FIG. 10 is a front view of a keypad assembly for an electronic device according to a second embodiment of the present invention.

As shown in FIG. 10, the keypad assembly 10 includes a first optical filtering layer 300 under the number face 31*a* and a second optical filtering layer 400 under the character face 32*a* of the key button.

The first optical filtering layer 300 is made of a first phosphor and the second optical filtering layer is made of a second phosphor.

Figure 11:
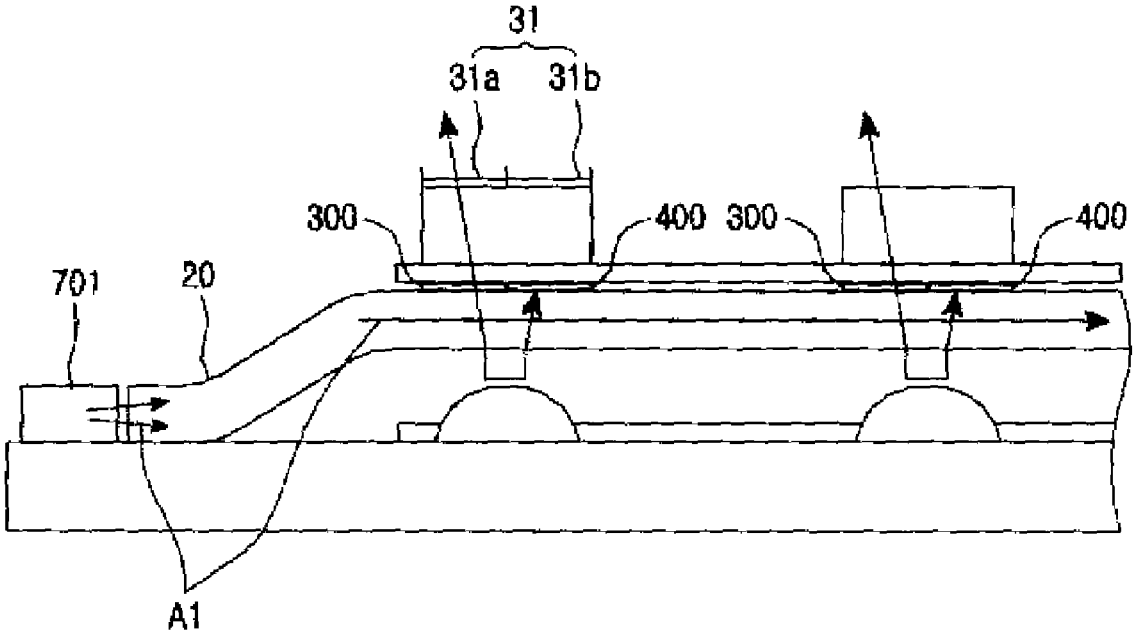
FIG. 11 is a cross-sectional view of a keypad assembly for an electronic device according to a second embodiment of the present invention, in which a first light emitting device emits a light.
Figure 13:
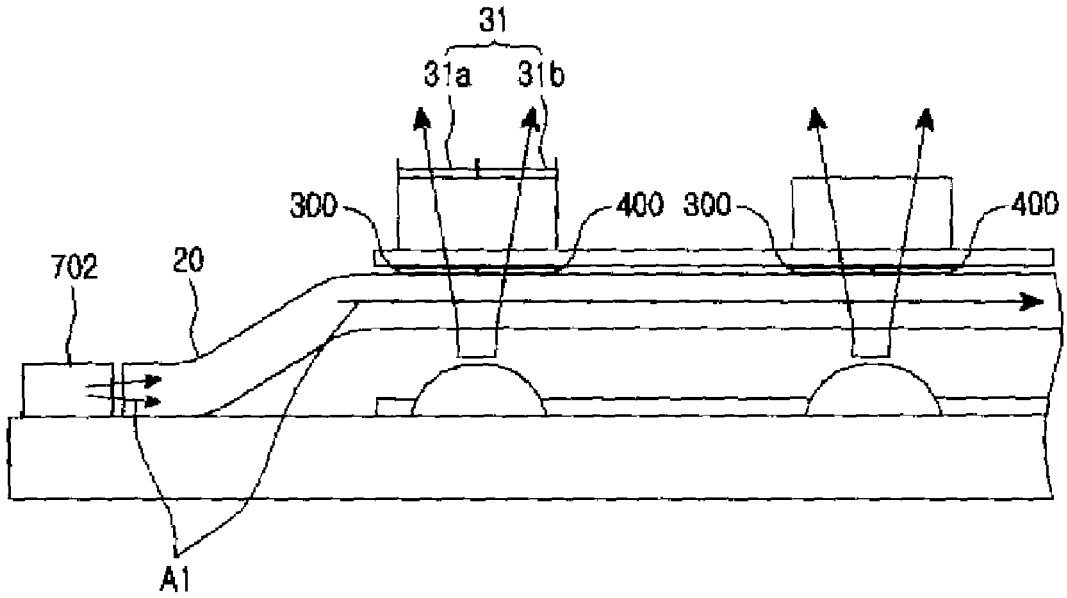
FIG. 13 is a cross-sectional view of a keypad assembly for an electronic device according to a second embodiment of the present invention, in which a second light emitting device emits a light.

As shown in FIGS. 11 and 13, the first optical filtering layer 300 is under the number face 31*a* and the second optical filtering layer 400 is under the character face 31*b*.

In this state, the first light emitting device 701 at a side of the keypad 10 is turned on to cause the first light emitting device 701 to emit a light. At this time, the second light emitting device 702 is in the OFF state.

Figure 12:
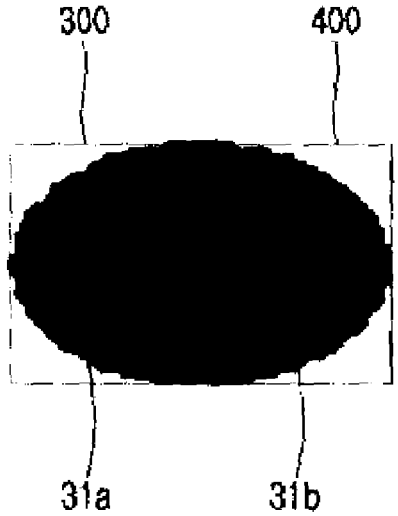
FIG. 12 is a front view of a keypad assembly for an electronic device according to a second embodiment of the present invention, in which key buttons are used when the first light emitting device emits a light.

As shown in FIGS. 11 and 12, when the first light emitting device 701 emits a violet light of 400 nm, the first optical filtering layer 300 reacts and illuminates the number face 31*a* of the key button 30 with another color (e.g., pink).

Figure 14:
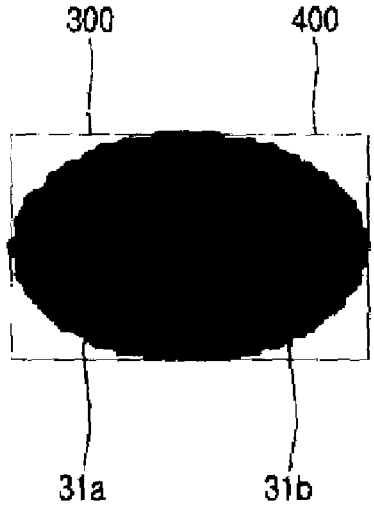
FIG. 14 is a front view of a keypad assembly for an electronic device according to a second embodiment of the present invention, in which the key buttons are used when the second light emitting device emits a light.

As shown in FIGS. 13 and 14, when the first light emitting device 701 is turned off and the second light emitting device 702 is turned on, the second light emitting device 702 emits a blue light of 470 nm.

In this case, the first optical filtering layer 300 and the second optical filtering layer 400 do not react to the input blue light, and the first optical filtering layer 300 illuminates the number face 31*a* of the key button 30 with a blue light and the second optical filtering layer 400 also illuminates the character face 31*b* of the key button 30 with a blue light.

As such, when the first light emitting device 701 emits a violet light of 400 nm, the first optical filtering layer 300 reacts and illuminates the number face 31*a* with pink color instead of violet and the second optical filtering layer 300 does not react and illuminates the character face 31*b* with a violet color.

When the second light emitting device 702 emits a blue light of 470 nm, the first optical filtering layer 300 and the second optical filtering layer 400 do not react and thus illuminate the number face 31*a* and the character face 31*b* with blue.

As described above, according to the present invention, by including at least one optical filtering layer (phosphor) whose color is changed into various colors by reacting or not reacting to the wavelengths of lights generated from at least two light emitting devices in key buttons of a terminal, number faces, character faces, and special character faces on the key buttons of the terminal can be illuminated with various colors according to the lights emitted from the optical filtering layer.

While the present invention has been shown and described with reference to preferred embodiments thereof, it will be understood by those skilled in the art that various changes in form and details may be made therein without departing from the spirit and scope of the invention.

What is claimed is:

1. A keypad assembly for an electronic device, comprising:

a light guide plate through which a light moves;

a plurality of first key buttons on a top surface of the light guide plate;

a plurality of reflecting patterns on a bottom surface of the light guide plate for reflecting the light moving through the light guide plate toward the first key buttons;

protrusions under the reflecting patterns;

a plurality of light emitting devices for supplying the light to the light guide plate;

a switch board including a plurality of dome switches; and at least one first optical filtering layer positioned under a select portion of each key button of a group of key buttons, a light color output by the filtering layer is changed into various colors by reacting or not reacting to wavelengths of lights generated from the light emitting devices.

2. The keypad assembly of claim 1, wherein the at least one first optical filtering layer is made of phosphor.

3. The keypad assembly of claim 2, wherein the phosphor emits red, green, blue lights, and combinations thereof.

4. The keypad assembly of claim 1, wherein each of the light emitting devices includes a first light emitting device and a second light emitting device, wherein the first light emitting device emits a light of substantially 400 nm and the second light emitting device emits a light of substantially 470 nm.

5. The keypad assembly of claim 1, wherein the at least one first optical filtering layer reacts and illuminates the first key buttons with various colors by emitting lights of various colors when a first light emitting device emits a light of 400 nm; and wherein the at least one first optical filtering layer does not react and illuminates the first key buttons with a single color by emitting lights of the single color when a second light emitting device emits a light of 470 nm.

6. The keypad assembly of claim 1, wherein printed faces, each including a number face and a character face are printed on the first key buttons and the at least one first optical filtering layer is selectively included under the number face or the character face.

7. The keypad assembly of claim 1, wherein the at least one first optical filtering layer is included under a number face of the first key buttons.

8. The keypad assembly of claim 1, further comprising:

a plurality of second key buttons providing special character faces; and second optical filtering layers positioned under the second key buttons for illuminating the special character faces with various colors by reacting to lights generated from a first light emitting device and a second light emitting device.

9. The keypad assembly of claim 1, wherein the light emitting devices are included adjacent to the dome switches of the switch board.

10. The keypad assembly of claim 1, wherein the at least one first optical filtering layer is installed under the first key buttons according to a traveling path of the light emitted from the light emitting devices.

11. A keypad assembly for an electronic device, comprising:

a light guide plate through which a light travels;

a plurality of key buttons on a top surface of the light guide plate;

a plurality of reflecting patterns on a bottom surface of the light guide plate for reflecting the light traveling through the light guide plate toward the key buttons;

protrusions under the reflecting patterns;

a plurality of light emitting devices for supplying the light to the light guide plate;

a switch board including a plurality of dome switches; and at least one first and second optical filtering layers positioned under a number face and a character face of each of the key buttons, respectively, the first and second optical filtering layers changing color of the generated light into various colors by reacting or not reacting to wavelengths of lights generated from the light emitting devices.

12. The keypad assembly of claim 11, wherein the at least one first optical filtering layer is made of phosphor and the at least one second optical filtering layer is made of a filtering layer.

13. The keypad assembly of claim 11, wherein each of the light emitting devices includes a first light emitting device and a second light emitting device.

14. The keypad assembly of claim 11, wherein the first at least one optical filtering layer reacts and illuminates the number face of the key buttons with a first color and the at least one second optical filtering layer does not react and illuminates the character face of the key buttons a second color when the first light emitting device emits a violet light of 400 nm; and wherein the at least one first optical filtering layer and the at least one second optical filtering layer do not react and illuminate the number face and the character face of the key buttons with a blue color, when the second light emitting device emits a blue light of 470 nm.

15. A keypad assembly for an electronic device including a switch board having a plurality of dome switches, the keypad assembly comprising:

a light guide plate through which a light moves;

a plurality of key buttons on a top surface of the light guide plate;

a plurality of reflecting patterns on a bottom surface of the light guide plate for reflecting the light moving through the light guide plate toward the key buttons;

protrusions under the reflecting patterns;

a plurality of light emitting devices included in the switch board; and a first optical filtering layer included under each of the key buttons, the optical filtering layer changing a color of input light into other colors by reacting or not reacting to wavelengths of lights generated from the light emitting devices.

16. The keypad assembly as recited in claim 15, wherein the optical layer is positioned under a portion of each of the key buttons.

17. The keypad assembly as recited in claim 16, wherein the key buttons are formed into groups of key buttons.

18. The keypad assembly as recited in claim 17, wherein the optical filter layer is a phosphor.

19. The keypad assembly as recited in claim 16, further comprising:

a second optical filtering unit positioned under a portion of each of the key buttons.

20. The keypad assembly as recited in claim 19, wherein the second optical layer is a filtering layer.

21. The keypad assembly as recited in claim 15, further comprising:

a third optical filtering unit positioned under a select group of the key buttons, wherein the third optical filtering unit chances the color of the generated light to a color different than the first and second optical filtering unit.

* * * * *